US011614699B2

(12) United States Patent
Ezawa

(10) Patent No.: US 11,614,699 B2
(45) Date of Patent: Mar. 28, 2023

(54) IMAGE FORMING APPARATUS WITH MOVING MECHANISM TO MOVE TENSION ROLLER WITH RESPECT TO AN ENDLESS BELT

(71) Applicant: FUJIFILM Business Innovation Corp., Tokyo (JP)

(72) Inventor: Satoshi Ezawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/583,616

(22) Filed: Jan. 25, 2022

(65) Prior Publication Data

US 2023/0060381 A1 Mar. 2, 2023

(30) Foreign Application Priority Data

Aug. 25, 2021 (JP) ..... JP2021-137633

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/0189; G03G 15/1605; G03G 15/1615
USPC ..... 399/298, 299, 302, 308
See application file for complete search history.

(56) References Cited

U.S. PATENT DOCUMENTS 8,175,477 B2 * 5/2012 Ishikawa ..... G03G 15/1615 399/302
8,311,465 B2 * 11/2012 Nomura et al. ... G03G 15/1615 399/302

FOREIGN PATENT DOCUMENTS

JP 2009-139473 A 6/2009

* cited by examiner

*Primary Examiner* — William J Royer
(74) *Attorney, Agent, or Firm* — Sughrue Mion, PLLC

(57) ABSTRACT

An image forming apparatus includes: an annular endless belt; a drive roller, around which the endless belt is wound and which moves the endless belt; a first tension roller, around which the endless belt moved by the drive roller is wound; a biasing mechanism connected to the first tension roller and including an elastic member that applies a tension to the endless belt via the first tension roller; a second tension roller, around which the endless belt moved by the drive roller is wound at a different position from the first tension roller; and a moving mechanism connected to the second tension roller to move the second tension roller in directions closer to and away from the endless belt. A range of adjustment of a circumferential length of the endless belt by the moving mechanism is larger than a range of adjustment of the circumferential length of the endless belt by the biasing mechanism.

20 Claims, 9 Drawing Sheets

IMAGE FORMING APPARATUS WITH MOVING MECHANISM TO MOVE TENSION ROLLER WITH RESPECT TO AN ENDLESS BELT

CROSS-REFERENCE TO RELATED APPLICATIONS

This application is based on and claims priority under 35 USC 119 from Japanese Patent Application No. 2021-137633 filed Aug. 25, 2021.

BACKGROUND

(i) Technical Field

The present disclosure relates to an image forming apparatus.

(ii) Related Art

Japanese Unexamined Patent Application Publication No. 2009-139473 discloses an image forming apparatus that includes a tension roller that applies a tension to an intermediate transfer belt by pressing the inner peripheral surface of the intermediate transfer belt outward, in which the pressing force of the tension roller is adjusted to adjust the tension applied to the intermediate transfer belt.

SUMMARY

An image may be distorted if the tension of an endless belt is varied by variations in the profile of the endless belt or disturbances caused in the endless belt due to a member (e.g. a transfer roller) that is in contact with the endless belt.

Aspects of non-limiting embodiments of the present disclosure relate to suppressing distortion of an image due to variations in the tension of an endless belt compared to the case where the circumferential length of the endless belt is adjusted and a tension is applied to the endless belt using one tension roller alone.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: an annular endless belt; a drive roller, around which the endless belt is wound and which moves the endless belt; a first tension roller, around which the endless belt moved by the drive roller is wound; a biasing mechanism connected to the first tension roller and including an elastic member that applies a tension to the endless belt via the first tension roller; a second tension roller, around which the endless belt moved by the drive roller is wound at a different position from the first tension roller; and a moving mechanism connected to the second tension roller to move the second tension roller in directions closer to and away from the endless belt, a range of adjustment of a circumferential length of the endless belt by the moving mechanism being larger than a range of adjustment of the circumferential length of the endless belt by the biasing mechanism.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings. In the following, features that are necessary to address the issue of the present disclosure will be described schematically, and features that are necessary to describe the corresponding portions of the present disclosure will be described principally. Features that are not described should be construed on the basis of the related art.

First Exemplary Embodiment

Figure 1:
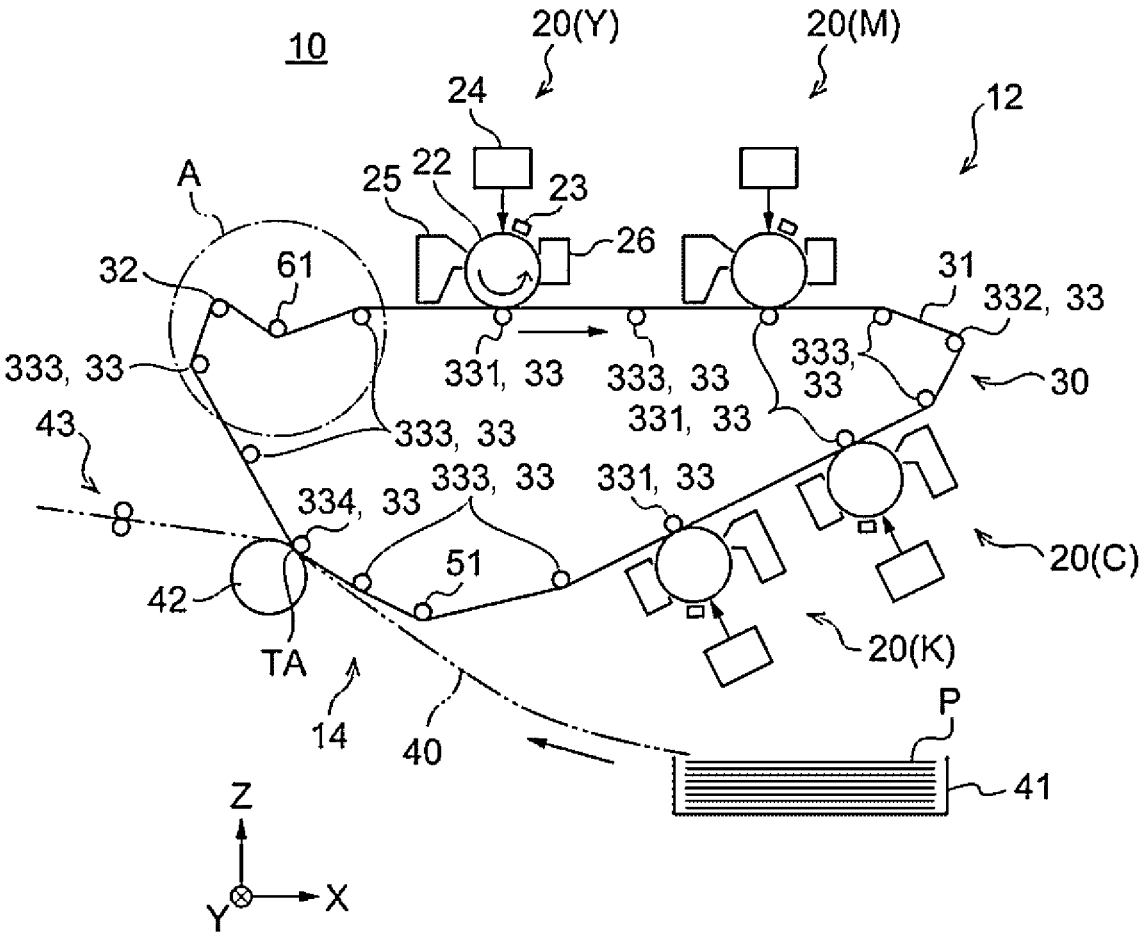
FIG. 1 schematically illustrates an example of an image forming apparatus according to a first exemplary embodiment of the present disclosure.

FIG. 1 schematically illustrates an example of an image forming apparatus according to a first exemplary embodiment of the present disclosure. As illustrated in FIG. 1, an image forming apparatus 10 according to the present exemplary embodiment may be an image forming apparatus of a so-called electrophotographic system that transfers a desired image (toner image) onto a recording medium P such as paper, for example. The image forming apparatus 10 may include an image forming section 12 and a transport section 14. FIG. 1 illustrates a portion of the image forming apparatus 10 as seen from the front. In the following description, the width direction is defined as X direction, the depth direction is defined as Y direction, and the height direction is defined as Z direction.

The image forming section 12 may be a section that forms a toner image (an example of the image) on the recording medium P. In order to form a toner image on the recording medium P, the image forming section 12 may include toner image forming sections 20 and a transfer device 30.

A plurality of toner image forming sections 20 may be disposed along the transport direction of an intermediate transfer belt 31 included in the transfer device 30, to be discussed later, in order to form a toner image for each color on the outer peripheral surface of the intermediate transfer belt 31. In the present exemplary embodiment, toner image forming sections 20 for four colors, namely yellow (Y), magenta (M), cyan (C), and black (K), are provided in this order from the upstream side in the transport direction of the intermediate transfer belt 31. The symbols (Y), (M), (C), and (K) used in FIG. 1 indicate constituent portions corresponding to the colors described above. In the following description, the reference numerals for members are followed by the symbols (Y), (M), (C), and (K) in the case where it is necessary to differentiate yellow (Y), magenta (M), cyan (C), and black (K) from each other. The symbols (Y), (M), (C), and (K) are occasionally omitted in the case where it is not necessary to differentiate yellow (Y), magenta (M), cyan (C), and black (K) from each other. Further, the toner image forming sections 20 for the respective colors may adopt similar configurations except for the type of toners. Thus, only the configuration of the toner image forming section 20(Y) will be described below as a representative of the toner image forming sections 20 for the respective colors. In FIG. 1, additionally, only various portions of the toner image forming section 20(Y) are given reference numerals, and the reference numerals for various portions of the other toner image forming sections are omitted. The toner image forming sections 20(Y) and 20(M) and the toner image forming sections 20(C) and 20(K), of the toner image forming sections 20, are different in the position relative to the intermediate transfer belt 31, and therefore are slightly different in the layout of the various portions, although the toner image forming sections 20 have the same constituent elements.

As illustrated in FIGS. 1, the toner image forming section 20(Y) may include a photosensitive drum 22 that is rotated in one direction (counterclockwise in FIG. 1). A charging unit 23, an exposure device 24, a developing device 25, and a removal device 26 are disposed in this order around the photosensitive drum 22.

An example of a process of a first transfer performed on the intermediate transfer belt 31 using the photosensitive drum 22 may be as follows. First, the photosensitive drum 22 is charged by the charging unit 23. Then, the photosensitive drum 22 which has been charged by the charging unit 23 is exposed to light using the exposure device 24 to form an electrostatic latent image on the photosensitive drum 22. Next, when an electrostatic latent image is formed, the electrostatic latent image is developed using the developing device 25 to form a toner image. Then, the toner image formed on the photosensitive drum 22 is transferred (first transfer) to the intermediate transfer belt 31 as a yellow image with the intermediate transfer belt 31 pressed against the photosensitive drum 22 by a first transfer roller 331 to be discussed later. Lastly, the removal device 26 removes a toner that remains on the surface of the photosensitive drum 22 after the transfer to the intermediate transfer belt 31. The toner image forming section 20(Y) transfers the yellow toner image onto the intermediate transfer belt 31 by performing the process discussed above at a specific timing.

The transfer device 30 may be a device that transfers toner images formed by the plurality of toner image forming sections 20 to the recording medium P. Specifically, the transfer device 30 includes an annular intermediate transfer belt (an example of an endless belt) 31 and a drive roller 32, around which the intermediate transfer belt 31 is wound to move the intermediate transfer belt 31 in one direction (clockwise in FIG. 1). The transfer device 30 may additionally include a plurality of support rollers 33, around which the intermediate transfer belt 31 is wound in order to support the intermediate transfer belt 31 with a profile along a desired path. In addition, the transfer device 30 further includes first and second tensioners 50, 60 (See FIGS. 2 and 3) that apply a tension to the intermediate transfer belt 31. The first and second tensioners 50, 60 will be discussed in detail later.

The intermediate transfer belt 31 may be constituted of an annular belt-like member, to the outer peripheral surface of which an image is to be transferred. The intermediate transfer belt 31 is disposed such that the width direction of the intermediate transfer belt 31 extends in the depth direction (Y direction) of the image forming apparatus 10. As illustrated in FIG. 1, the intermediate transfer belt 31 is wound around the drive roller 32 and the plurality of support rollers 33 to be supported with a desired profile (posture).

The drive roller 32 is connected to a drive source such as a motor (not illustrated), and rotated upon receiving a drive force from the drive source to move the intermediate transfer belt 31 which is wound around the drive roller 32. The drive roller 32 according to the present exemplary embodiment is disposed in contact with the inner peripheral surface of the intermediate transfer belt 31 downstream of a transfer region TA, at which a second transfer is performed, and upstream of the toner image forming section 20(Y) in the transport direction of the intermediate transfer belt 31. The axial length of the drive roller 32 may be slightly larger than the width of the intermediate transfer belt 31. The drive roller 32 may be disposed such that the axial direction of the drive roller 32 extends along the depth direction (Y direction) of the image forming apparatus 10.

The plurality of support rollers 33 may be rollers that support the intermediate transfer belt 31 from the inner peripheral side of the intermediate transfer belt 31 such that the intermediate transfer belt 31 has a desired profile. The plurality of support rollers 33 may include: a plurality of (four in FIG. 1) first transfer rollers 331 disposed to face the photosensitive drums 22 of the toner image forming sections 20 for the respective colors to press the intermediate transfer belt 31 against the photosensitive drums 22 such that the intermediate transfer belt 31 is positioned between the photosensitive drums 22 and the first transfer rollers 331; a steering roller 332 that suppresses meandering and deviation of the intermediate transfer belt 31; a plurality of (seven in FIG. 1) driven rollers 333 disposed at appropriate locations in the image forming section 12 to determine the profile of the intermediate transfer belt 31; and a second transfer roller 334 that presses the intermediate transfer belt 31 toward a transfer drum 42, to be discussed later, to transfer (second transfer) the toner images formed on the intermediate transfer belt 31 onto the recording medium P transported along the transfer drum 42. A known configuration may be adopted as the specific configuration of the plurality of types of support rollers discussed above. The axial length of the plurality of support rollers 33 may be slightly larger than the width of the intermediate transfer belt 31. The diameter of the support rollers 33 may be adjusted as appropriate in accordance with the purpose of use thereof. Further, the plurality of support rollers 33 may be disposed such that the axial direction of the support rollers 33 extends along the depth direction (Y direction) of the image forming apparatus 10.

The transport section 14 performs a sequence of transport processes in which images are transferred to the recording medium P and the recording medium P is ejected out of the image forming apparatus 10, and may include a transport path 40 through which the recording medium P is transported. The transport path 40 starts at a storage section 41 that stores the recording medium P before image formation, passes through the transfer region TA formed between the transfer drum 42, which is an example of a transfer roller, and the intermediate transfer belt 31, and thereafter passes between a pair of rollers that constitute a fixing device 43 that fixes the transferred images to the recording medium P to be able to eject the recording medium P, on which the images have been printed, to an ejection tray (not illustrated) provided on the image forming apparatus 10. A plurality of transport rollers (not illustrated) may be disposed along the transport path 40.

A part of the outer peripheral surface of the transfer drum 42 is in contact with the intermediate transfer belt 31. The contact portion serves as the transfer region TA. The transfer drum 42 may include a drive source (e.g. a motor) that rotationally drives the transfer drum 42 independently of the intermediate transfer belt 31, or may not include a drive source but be a roller that is rotated along with movement of the intermediate transfer belt 31, with which a part of the transfer drum 42 is in contact.

In addition to the components discussed above, the transfer device 30 further includes the first tensioner 50 and the second tensioner 60. The specific structure etc. of the two tensioners 50, 60 of the image forming apparatus 10 according to the present exemplary embodiment will be sequentially described below.

Figure 2:
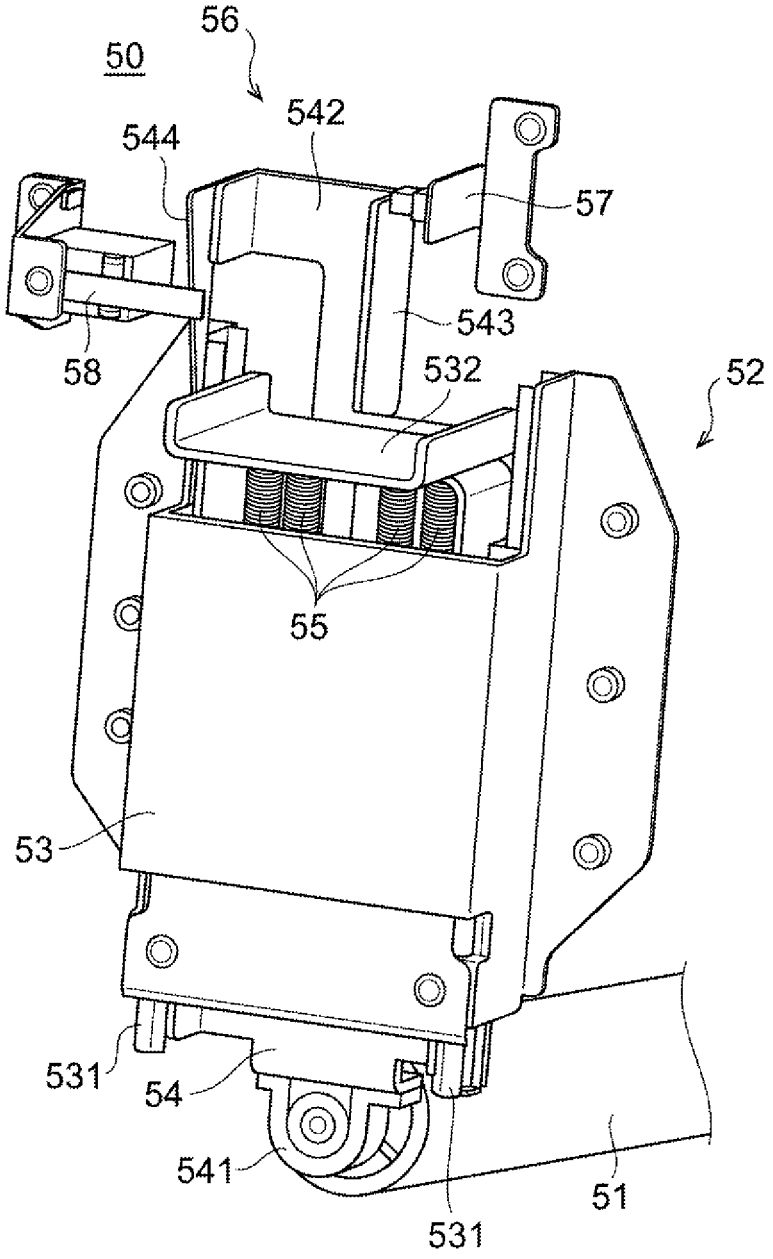
FIG. 2 is a schematic perspective view illustrating an example of a first tensioner of the image forming apparatus illustrated in FIG. 1.

FIG. 2 is a schematic perspective view illustrating an example of the first tensioner 50 of the image forming apparatus 10 illustrated in FIG. 1. The first tensioner 50 according to the present exemplary embodiment includes a first tension roller 51 and a pair of biasing mechanisms 52 fixed at both end portions of the first tension roller 51 in the longitudinal direction. In FIG. 2, only one of the pair of biasing mechanisms 52 that is disposed on the front side in the depth direction and a part of the first tension roller 51 attached to the biasing mechanism 52 are illustrated. The pair of biasing mechanisms 52 may include similar components except for the arrangement of such components. Therefore, only one of the biasing mechanisms 52 will be described below.

As illustrated in FIGS. 1 and 2, the first tension roller 51 is a roller provided on the inner peripheral side of the intermediate transfer belt 31 to apply a tension to the intermediate transfer belt 31. The first tension roller 51 may be disposed at a position downstream of the plurality of toner image forming sections 20 in the transport direction of the intermediate transfer belt 31 and upstream of the transfer region TA so as to press the intermediate transfer belt 31 from the inner peripheral side. It is considered that a tension is fluctuated relatively easily because of disturbances due to contact of the transfer drum 42 or passage of the recording medium P at the position immediately before the transfer region TA, at which the first tension roller 51 is disposed, compared to other positions along the entire circumference of the intermediate transfer belt 31.

The biasing mechanism 52 is a mechanism that biases the first tension roller 51 toward the intermediate transfer belt 31 in order to apply a tension to the intermediate transfer belt 31. The biasing mechanism 52 may include a first fixed portion 53 fixed to the body of the image forming apparatus 10, a slider 54, to which the first tension roller 51 is fixed and at least a part of which is housed in the first fixed portion 53, and springs (an example of an elastic member) 55, at which respective first ends of which are attached to the slider 54.

Both end portions of the first fixed portion 53 in the right-left direction (X direction) may be fixed to the body of the image forming apparatus 10, and a middle portion of the first fixed portion 53 positioned between the both fixed end portions may be bent in the direction away from the body of the image forming apparatus 10. The inside of the first fixed portion 53, which is surrounded by the middle portion of the first fixed portion 53 and the body of the image forming apparatus 10, forms a space that is open at both end portions in the up-down direction (Z direction). Rails 531 are attached to both side surfaces of the inside space of the first fixed portion 53 to movably support the slider 54. A plate-like spring attachment portion 532 for attachment of the springs 55 is fixed to the upper portion of the first fixed portion 53 in the up-down direction.

A part of the slider 54 may be housed in the first fixed portion 53 so that the slider 54 is slidable in the up-down direction along the rails 531 provided on the first fixed portion 53. A roller fixing portion 541 for fixation of an end portion of a rotary shaft of the first tension roller 51 may be provided on the lower end surface of the slider 54 in the up-down direction. Likewise, the springs 55 may be attached to the upper end surface (not illustrated) of the slider 54. While the slider 54 according to the present exemplary embodiment is illustrated as being movable in the up-down direction, the direction of movement of the slider 54 may be adjusted as appropriate. For example, the direction of movement of the slider 54 may be a direction inclined with respect to the up-down direction by an acute angle.

The springs 55 may bias the slider 54 principally downward in the up-down direction to bias the first tension roller 51, which is fixed to the slider 54, toward the intermediate transfer belt 31. Specifically, the intermediate transfer belt 31 may be pressed using the plurality of springs 55, the respective first ends of which are attached to the upper end surface of the slider 54 and the respective second ends of which are attached to the spring attachment portion 532. While coil springs are illustrated as an example of the springs 55 in FIG. 2, any elastic member other than the coil springs may be adopted.

As seen from the above configuration, the first tensioner 50 elastically applies a tension to the intermediate transfer belt 31 using the springs 55 with biasing forces determined by the material etc. In other words, it is considered that the first tensioner 50 is a tensioner that maintains a tension on the intermediate transfer belt 31 with a constant load.

The biasing mechanism 52 may also include a position detection section 56 that detects the position of the first tension roller 51. The position detection section 56 may detect the relative position of the slider 54 to specify the position of the first tension roller 51. Specifically, the position detection section 56 may include a tensioner limit sensor 57 that detects whether or not the slider 54 is located at a desired position (zero point), and a tensioner position sensor 58 that specifies the present position of the slider 54. The tensioner limit sensor 57 may include a photosensor. The tensioner position sensor 58 may include an analog sensor. In this respect, the slider 54 may be provided with a tongue piece 542 that extends upward in the up-down direction, where the position detection section 56 discussed above is disposed, from the principal portion of the slider 54. The tongue piece 542 may include a tensioner limit sensor passage portion 543 that passes by a detection surface of the photosensor included in the tensioner limit sensor 57 to block light radiated by the photosensor, and an inclined surface 544 that contacts a contact element of the analog sensor included in the tensioner position sensor 58. The tensioner limit sensor 57 and the tensioner position sensor 58 may specify the position of the slider 54 with the tongue piece 542 operating along with movement of the slider 54. Specifically, the initial position of the tensioner position sensor 58 may be specified using the detection result from the tensioner limit sensor 57, and the position of the slider 54 may be specified in accordance with the detection result from the tensioner position sensor 58. While the tensioner limit sensor 57 and the tensioner position sensor 58 are adopted as an example of the position detection section 56 in the present exemplary embodiment, the present disclosure is not limited thereto. For example, the position of the first tension roller 51 may be specified using the tensioner position sensor 58 alone or the tensioner limit sensor 57 alone, or using a sensor other than the sensors discussed above.

It is considered that the first tensioner 50 configured as described above absorbs a reduction in the tension caused in the intermediate transfer belt 31 by adjusting the circumferential length of the intermediate transfer belt 31 by elastically pressing a portion of the intermediate transfer belt 31 upstream of the transfer region TA using the springs 55 with a specific elastic force. It is necessary to increase the distance of movement of the slider 54 if an attempt is made to increase the range of adjustment of the circumferential length of the intermediate transfer belt 31 with the first tensioner 50, in order to absorb relatively large variations in the profile of the intermediate transfer belt 31 using the first tensioner 50 alone, for example. As illustrated in FIG. 1, however, the profile of the intermediate transfer belt 31 is varied relatively gently at the position at which the first tensioner 50 is disposed, compared to the position at which the drive roller 32 is disposed and the position at which the steering roller 332 is disposed. Thus, if the slider 54 of the first tensioner 50 is moved over a long distance, the biasing force of the first tension roller 51 to bias the intermediate transfer belt 31 is increased greatly, and the intermediate transfer belt 31 tends to be curly since the intermediate transfer belt 31 is pressed with the great biasing force at all times. If the slider 54 is moved over a long distance, in addition, the profile of the intermediate transfer belt 31 which is pressed by the first tension roller 51 is varied greatly. Great variations in the profile of the intermediate transfer belt 31 may fluctuate the area of contact of rollers (e.g. the driven rollers 333 and the second transfer roller 334) that are adjacent to the first tension roller 51 with the intermediate transfer belt 31, for example, which may make support for the intermediate transfer belt 31 by such rollers unstable. If support for the intermediate transfer belt 31 is unstable, the intermediate transfer belt 31 may be susceptible to disturbances, which may cause distortion of an image. In the present disclosure, in consideration of such an issue, the second tensioner 60 is adopted in addition to the first tensioner 50.

Figure 3:
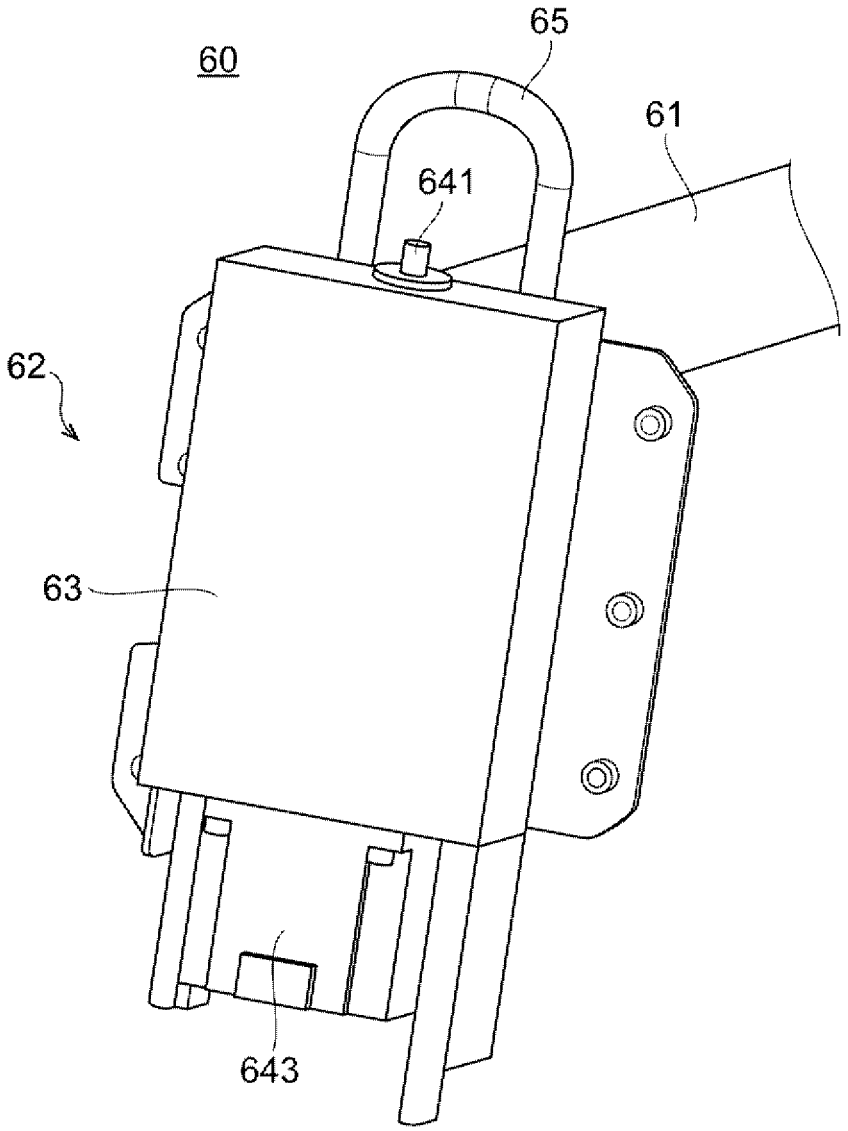
FIG. 3 is a schematic perspective view illustrating an example of a second tensioner of the image forming apparatus illustrated in FIG. 1.
Figure 4:
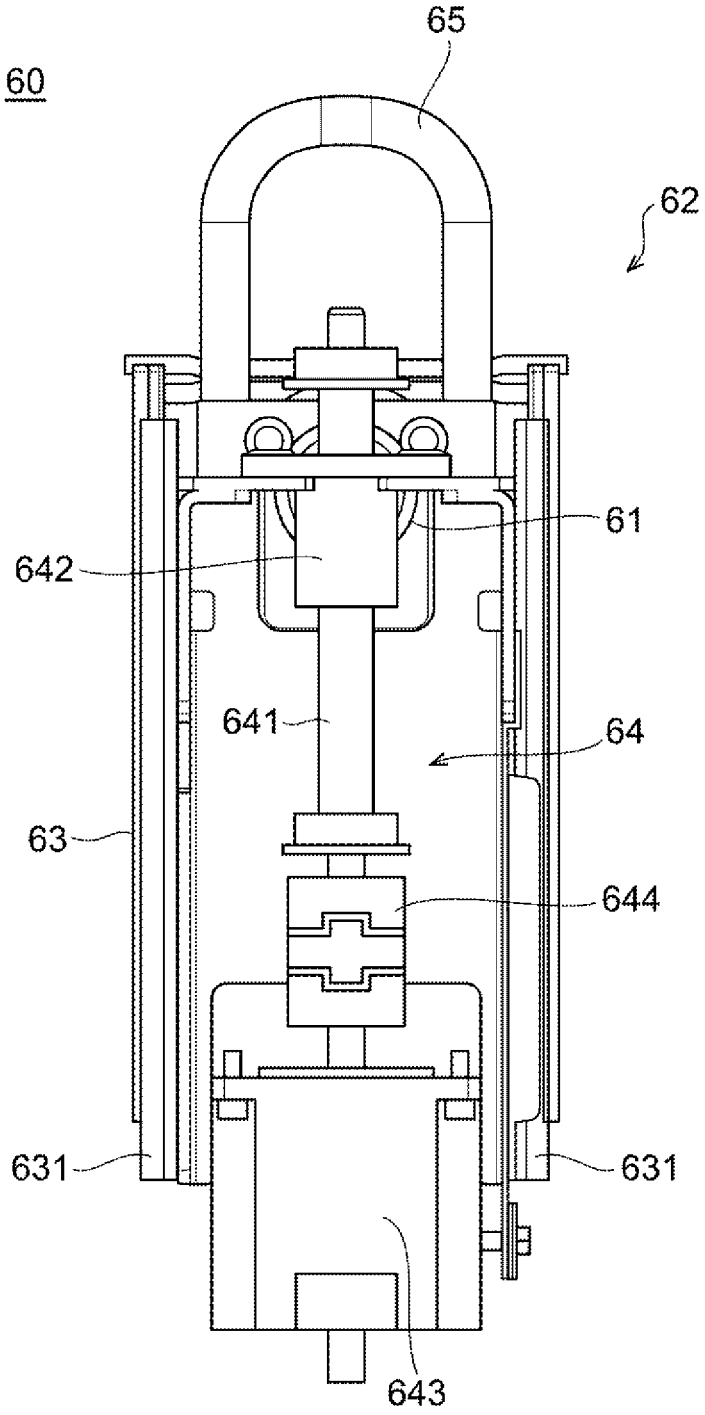
FIG. 4 illustrates an example of the internal structure of the second tensioner illustrated in FIG. 3.

FIG. 3 is a schematic perspective view illustrating an example of the second tensioner 60 of the image forming apparatus 10 illustrated in FIG. 1. FIG. 4 illustrates an example of the internal structure of the second tensioner 60 illustrated in FIG. 3. As illustrated in FIGS. 3 and 4, the second tensioner 60 includes a second tension roller 61 and a pair of moving mechanisms 62 fixed at both end portions of the second tension roller 61 in the longitudinal direction. In FIG. 3, only one of the pair of moving mechanisms 62 that is disposed on the front side in the depth direction and a part of the second tension roller 61 attached to the moving mechanism 62 are illustrated. In FIG. 4, a part of a second fixed portion 63, to be discussed later, is illustrated as being transparent in order to make the internal structure of the second tensioner 60 visually recognizable. The pair of moving mechanisms 62 may include similar components except for the arrangement of such components. Therefore, only one of the moving mechanisms 62 will be described below.

As illustrated in FIGS. 1, 3, and 4, the intermediate transfer belt 31 is wound around the second tension roller 61, and the second tension roller 61 applies a tension to the intermediate transfer belt 31 in order to adjust the circumferential length of the intermediate transfer belt 31. The second tension roller 61 may be disposed in the vicinity of the drive roller 32, for example. In the present exemplary embodiment, the second tension roller 61 is disposed downstream of the drive roller 32 and upstream of the plurality of toner image forming sections 20 in the transport direction of the intermediate transfer belt 31.

The moving mechanism 62 is a mechanism that moves the second tension roller 61 in directions closer to and away from the intermediate transfer belt 31. The moving mechanism 62 may include the second fixed portion 63 fixed to the body of the image forming apparatus 10, and a direct-acting mechanism 64, at least a part of which is housed in the second fixed portion 63.

Both end portions of the second fixed portion 63 in the right-left direction (X direction) may be fixed to the body of the image forming apparatus 10, and a middle portion of the second fixed portion 63 positioned between the both fixed end portions may be bent in the direction away from the body of the image forming apparatus 10. The inside of the second fixed portion 63, which is surrounded by the middle portion of the second fixed portion 63 and the body of the image forming apparatus 10, forms a space that houses the direct-acting mechanism 64. Rails 631 are attached to both side surfaces of the inside space of the second fixed portion 63 to guide movement of a nut 642 of the direct-acting mechanism 64 to be discussed later. The upper portion of the second fixed portion 63 in the up-down direction is closed in order to rotatably support a lead screw 641 to be discussed later.

The direct-acting mechanism 64 supports the second tension roller 61, and moves the second tension roller 61 in the up-down direction (Z direction). In the present exemplary embodiment, a screw nut is adopted as the direct-acting mechanism 64. The direct-acting mechanism 64 may include the lead screw 641, the nut 642, and a stepping motor 643. While a screw nut is used as the direct-acting mechanism 64 in the present exemplary embodiment, other direct-acting mechanisms (e.g. a linear motor, a single-axis robot, etc.) may also be adopted. Likewise, while a stepping motor 643 is adopted as a drive source in the direct-acting mechanism according to the present exemplary embodiment, other drive sources (e.g. a servomotor) may also be adopted.

The lead screw 641 is a bar-shaped shaft body, at the outer periphery of which threads are formed, and is disposed in the second fixed portion 63 so as to extend along the up-down direction. The nut 642 is rotatably attached to the lead screw 641. Rotating the lead screw 641 moves the nut 642 in the up-down direction. A shaft of the second tension roller 61 is attached to the nut 642. When the nut 642 is moved along the lead screw 641, the second tension roller 61 is also moved accordingly. Consequently, the second tension roller 61 is moved in directions closer to and away from the intermediate transfer belt 31. The left and right end portions of the nut 642 are movably supported by the rails 631 provided on the second fixed portion 63. The rails 631 guide movement of the nut 642 along the lead screw 641, and suppress rotation of the nut 642 accompanying rotation of the lead screw 641.

The stepping motor 643 may rotate the lead screw 641 with a rotary shaft of the stepping motor 643 connected to one end of the lead screw 641 via a coupling 644. The rotational angle and the rotational speed of the stepping motor 643 are controllable by a control unit (not illustrated) of the image forming apparatus 10, for example. The other end of the lead screw 641 opposite to the one end, to which the rotary shaft of the stepping motor 643 is connected, is rotatably supported by the second fixed portion 63. The control unit may constitute a principal controller of the image forming apparatus 10. The principal controller may be constituted of a known computer that specifically includes at least a volatile or non-volatile memory (e.g. a random access memory (RAM) and a hard disk drive (HDD)) and a processor such as a central processing unit (CPU).

With the second tensioner 60 configured as discussed above, the position (amount of displacement) of the second tension roller 61 is variable by controlling the rotational angle of the stepping motor 643 using the moving mechanism 62. Thus, the amount by which the intermediate transfer belt 31 is pressed by the second tension roller 61 is variable with the second tensioner 60. In this respect, in the present exemplary embodiment, it should be particularly noted that the range of adjustment of the circumferential length of the intermediate transfer belt 31 by the moving mechanism 62 is set so as to be large compared to the range of adjustment of the circumferential length of the intermediate transfer belt 31 by the biasing mechanism 52.

In general, portions that are adjacent to the transfer region TA are most susceptible to disturbances from the recording medium P etc. which passes through the transfer drum 42 and the transfer region TA. In particular, images have been formed by the toner image forming sections 20 on a portion of the intermediate transfer belt 31 which is moved upstream of the transfer region TA. Therefore, images may be distorted if the tension on such a portion is insufficient. On the other hand, the profile of the intermediate transfer belt 31 is varied relatively gently at the portion. Therefore, if a tension roller that is greatly displaceable is disposed at the position, the size etc. of the transfer region TA may not be stable because of the effect of the biasing force from the tension roller. In the image forming apparatus 10 according to the present exemplary embodiment, two tensioners 50, 60 are used in combination in consideration of the factor discussed above. That is, the circumferential length of the intermediate transfer belt 31 is adjusted by the second tensioner 60 relatively greatly, which allows the first tensioner 50 to be disposed at a position adjacent to the transfer region TA since it is only necessary for the first tensioner 50 to press the intermediate transfer belt 31 with a relatively small biasing force.

The second tension roller 61 of the second tensioner 60 is preferably moved on the basis of the operation state of the image forming apparatus 10. Specifically, the tension to be applied to the intermediate transfer belt 31 is preferably positively reduced at a timing when image formation is not performed such as when the image forming apparatus 10 has been turned off.

Optionally, the second tension roller 61 of the second tensioner 60 according to the present exemplary embodiment is preferably disposed so as to press the outer peripheral surface of the intermediate transfer belt 31 as illustrated in FIG. 1. When the second tension roller 61 presses the outer peripheral surface of the intermediate transfer belt 31 in this manner, a relatively large range of adjustment of the circumferential length of the intermediate transfer belt 31 is obtained with a small constraint on the arrangement compared to when the second tension roller 61 presses the inner peripheral surface of the intermediate transfer belt 31. Since the toner image forming sections 20 form images on the outer peripheral surface of the intermediate transfer belt 31, the second tension roller 61 is preferably disposed at a position at which the images on the intermediate transfer belt 31 are not distorted because of contact with the second tension roller 61 and toners are not likely to adhere to the second tension roller 61. Specifically, the second tension roller 61 is preferably disposed upstream of the plurality of toner image forming sections 20 and downstream of the transfer region TA in the transport direction of the intermediate transfer belt 31 as illustrated in FIG. 1.

Optionally, the second tensioner 60 is preferably disposed on the upper side of the transfer device 30 in the up-down direction in consideration of the maintainability. The second tensioner 60 disposed on the upper side of the transfer device 30 is removable relatively easily by moving the second tensioner 60 upward. In this respect, as illustrated in FIGS. 3 and 4, a handle 65 may be provided on top of the second fixed portion 63 of each of the pair of moving mechanisms 62 to be held when a worker etc. moves the second tensioner 60 etc.

Figure 5:
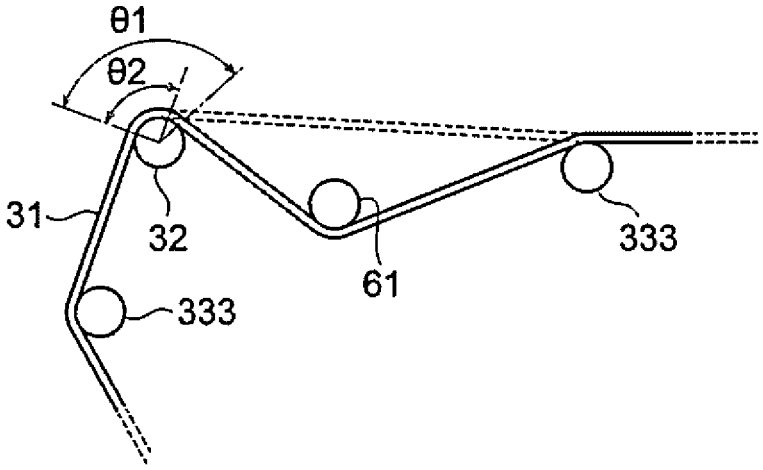
FIG. 5 illustrates a portion A in FIG. 1 as enlarged.

FIG. 5 illustrates a portion A in FIG. 1 as enlarged. In addition to the options described above, the second tension roller 61 of the second tensioner 60 according to the present exemplary embodiment is still more preferably disposed at a position adjacent to the drive roller 32. When the second tension roller 61 is disposed adjacent to the drive roller 32, as illustrated in FIG. 5, the area of contact between the intermediate transfer belt 31 and the drive roller 32 is increased as the intermediate transfer belt 31 is pressed by the second tension roller 61. Specifically, an angle (hereinafter this angle will be referred to as a "wrap angle") 01 formed by a portion of the intermediate transfer belt 31 wrapped around the drive roller 32 at this time is larger than a wrap angle θ2 at the time when the second tension roller 61 is not disposed adjacent to the drive roller 32 (in the state indicated by the dotted line in FIG. 5). While the second tension roller 61 is disposed downstream of the drive roller 32 in FIG. 5, the second tension roller 61 may be disposed upstream of the drive roller 32.

Figure 6:
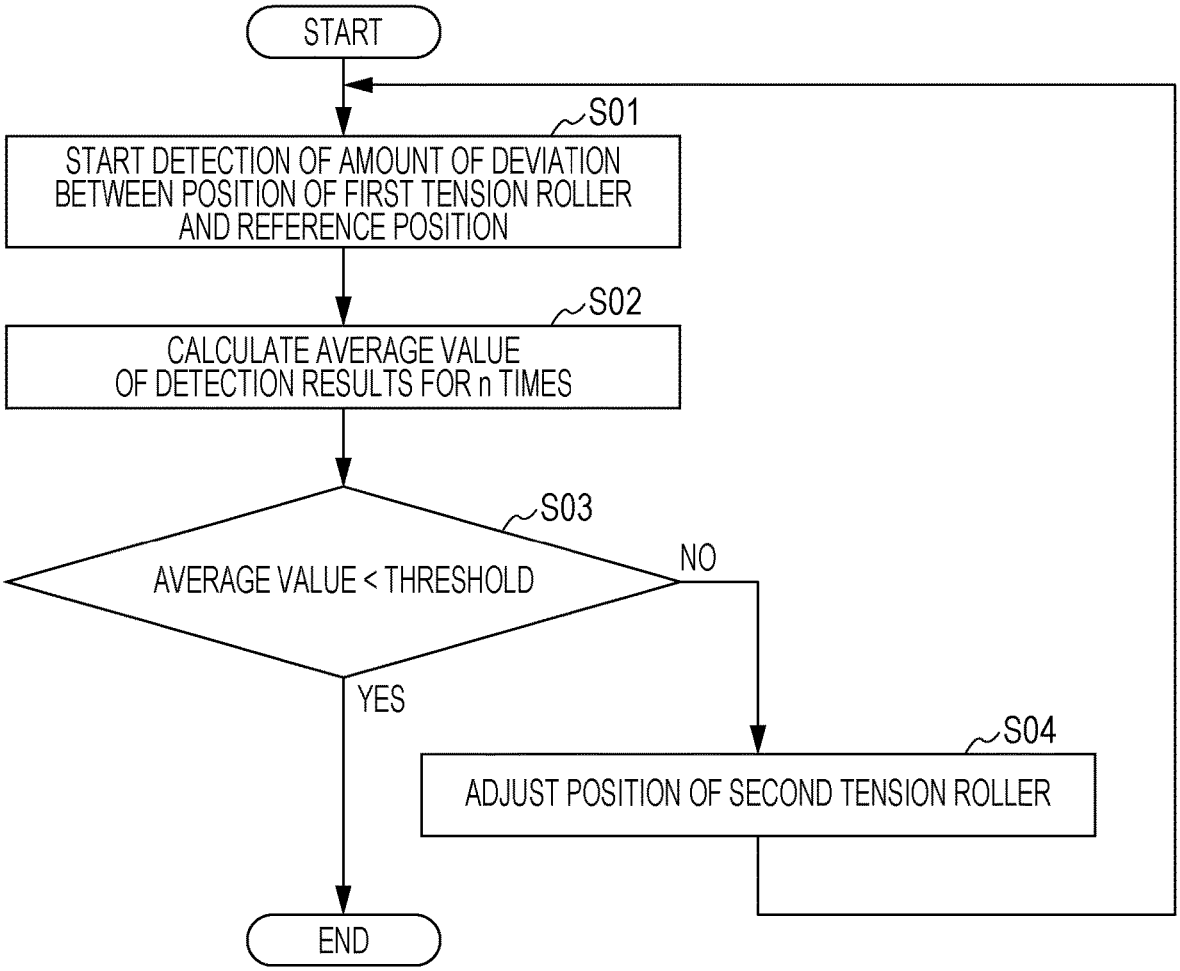
FIG. 6 is a flowchart illustrating an example of a method of controlling the profile of an intermediate transfer belt of the image forming apparatus according to the first exemplary embodiment of the present disclosure.

Next, a specific example of a method of controlling the profile of the intermediate transfer belt 31 using the two tensioners 50, 60 discussed above will be described briefly. FIG. 6 is a flowchart illustrating an example of a method of controlling the profile of the intermediate transfer belt 31 of the image forming apparatus 10 according to the first exemplary embodiment of the present disclosure. This profile control is preferably started at timings such as when power is turned on and when image forming operation is executed. When the profile control is started, first, acquisition of the detection result from the tensioner position sensor 58 at time intervals (e.g. 1 ms) set in advance is started, and detection of the amount of deviation between the position of the first tension roller 51 and a reference position set in advance is started (step S01). When the detection results of the amounts of deviation for n times (e.g. 16 times) are obtained, an average value of the detection results is calculated (step S02). It is determined whether or not the calculated average value of the amounts of deviation is less than a threshold set in advance (step S03). The threshold may be the value of an amount of deviation corresponding to an allowable position of the first tension roller 51 that is the closest to the intermediate transfer belt 31. The specific value of the threshold may be set in advance through experiments etc. Thus, in the case where the average value of the amounts of deviation between the position of the first tension roller 51 and the reference position set in advance is equal to or more than the threshold, it is meant that the position of the first tension roller 51 greatly deviates from the reference position, more specifically that the first tension roller 51 is further beyond the allowable position that is the closest to the intermediate transfer belt 31.

In the case where the average value of the amounts of deviation is less than the threshold (Yes in step S03) as a result of the above determination, it is considered that the circumferential length of the intermediate transfer belt 31 has been adjusted appropriately and an appropriate tension is applied from the first tensioner 50 to the intermediate transfer belt 31, and the sequence of the profile control is completed. In the case where the average value of the amounts of deviation is not less than the threshold (No in step S03), on the other hand, it is determined that the intermediate transfer belt 31 is not supported with an appropriate profile because of variations in the circumferential length of the intermediate transfer belt 31, and adjustment of the circumferential length is executed using the second tensioner 60 (step S04). Specifically, the tension applied to the intermediate transfer belt 31 is increased by adjusting the position of the second tension roller 61 so as to move the second tension roller 61 in the direction closer to the intermediate transfer belt 31 by driving the stepping motor 643. When the adjustment operation is completed, the process returns to step S01, and steps S01 to S03 are repeatedly performed until the average value of the amounts of deviation becomes less than the threshold.

In the image forming apparatus 10 according to the present exemplary embodiment, the profile of the intermediate transfer belt 31 is adjusted each time the image forming apparatus 10 is turned on, or each time image forming operation is executed, by executing the profile control discussed above. While a state in which the tension for the intermediate transfer belt 31 is insufficient is principally resolved in the above description of the profile control method, the profile control may also be executed upon detecting a state in which the tension applied to the intermediate transfer belt 31 is excessively large. The specific method is the same as the method discussed above except for the threshold to be set etc., and thus is not described.

Second Exemplary Embodiment

Some image forming apparatuses have a plurality of modes. Specific examples include a monochrome printing mode and a full-color printing mode, which are known to use different toner image forming sections. When different toner image forming sections are used in accordance with the mode in this manner, the profile of the intermediate transfer belt is occasionally changed such that the intermediate transfer belt does not contact a toner image forming section that is not being used. The range of adjustment of the circumferential length of the intermediate transfer belt that is necessary in order to maintain the tension of the intermediate transfer belt is large for the image forming apparatuses in which the profile of the intermediate transfer belt is changed in this manner, compared to image forming apparatuses in which the profile of the intermediate transfer belt is not changed. An image forming apparatus 10A in which the profile of the intermediate transfer belt is positively changeable as discussed above will be described below as a second exemplary embodiment of the present disclosure.

Figure 7A:
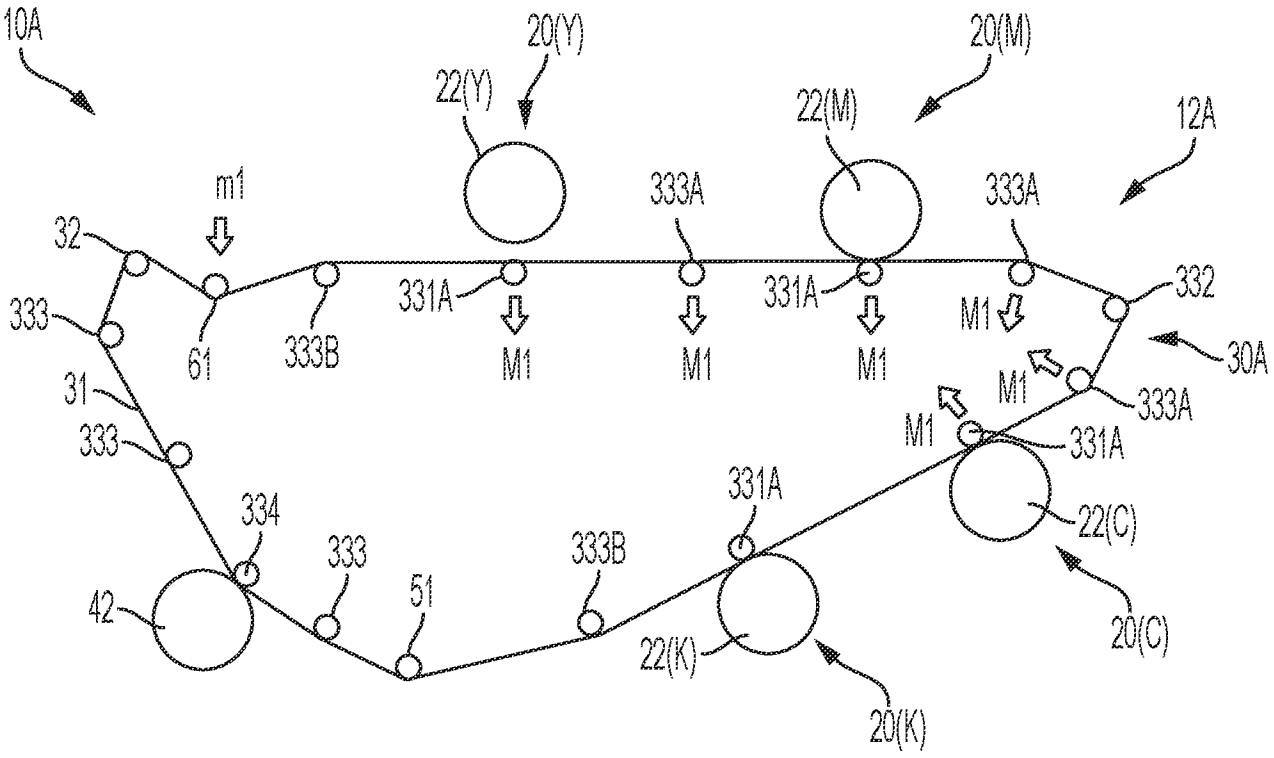
FIGS. 7A to 7C schematically illustrate an example of an image forming apparatus according to a second exemplary embodiment of the present disclosure, with FIG. 7A illustrating a state in which the image forming apparatus operates in a full-color printing mode, FIG. 7B illustrating a state in which the image forming apparatus operates in a monochrome printing mode, and FIG. 7C illustrating a hibernated state.
Figure 7B:
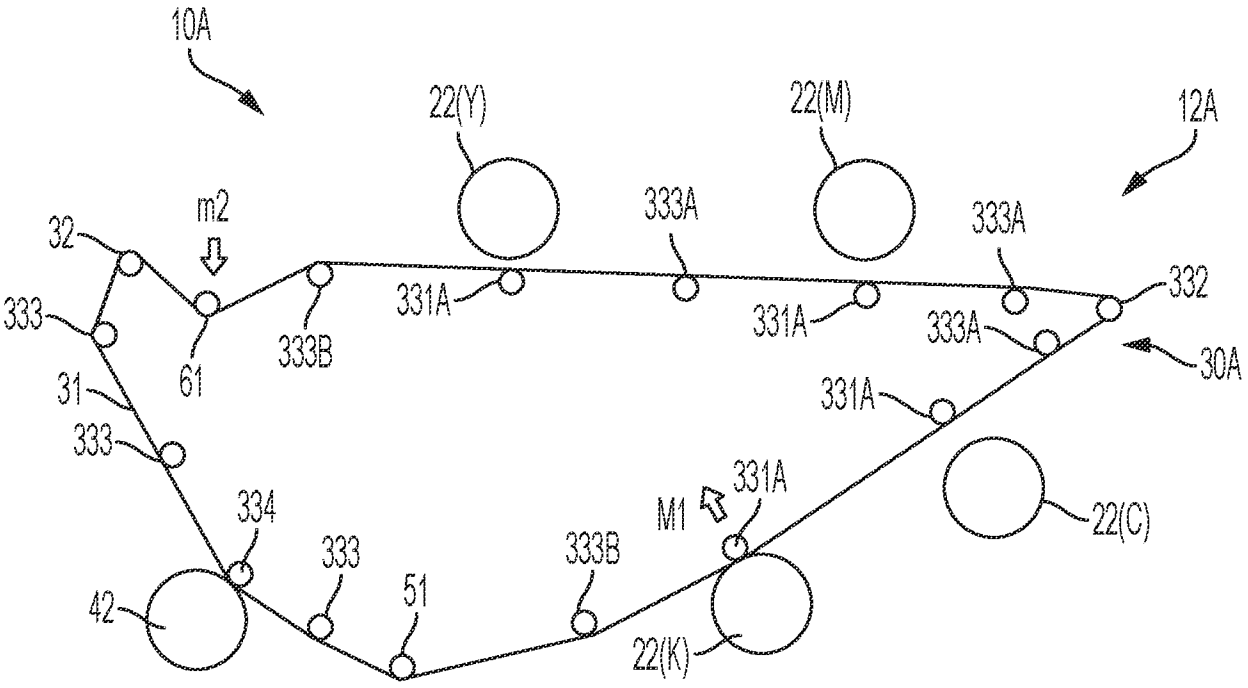
Figure 7C:
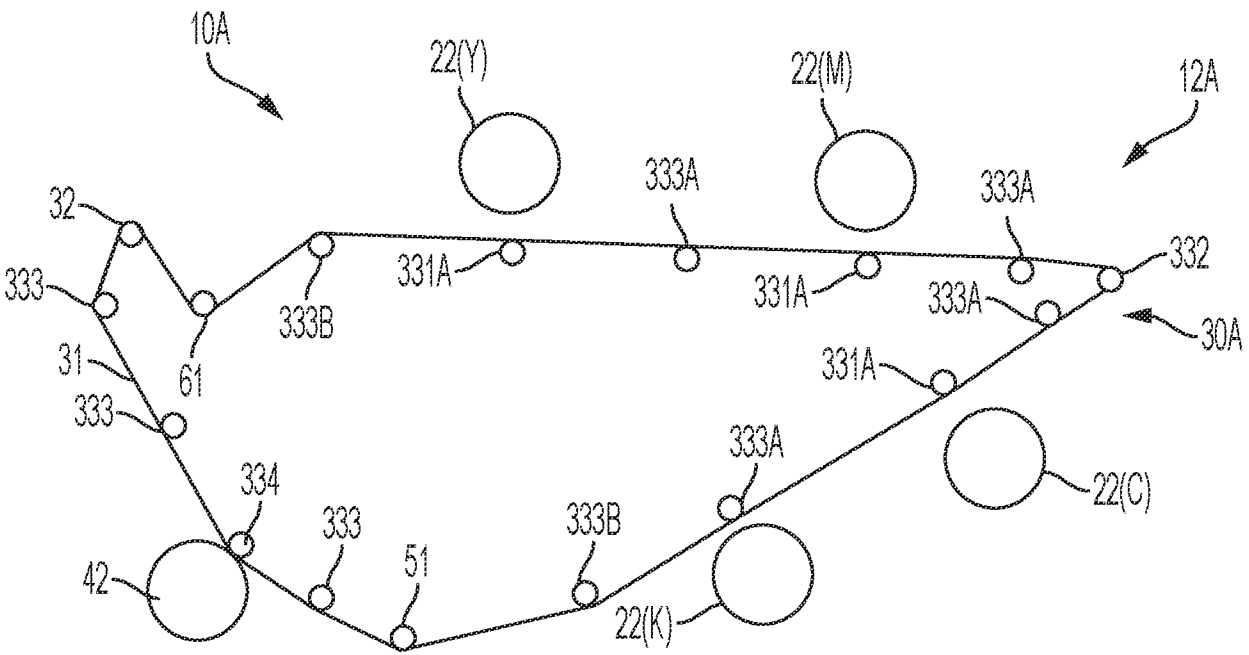

FIGS. 7A to 7C schematically illustrate an example of an image forming apparatus 10A according to a second exemplary embodiment of the present disclosure, with FIG. 7A illustrating a state in which the image forming apparatus 10A operates in a full-color printing mode, FIG. 7B illustrating a state in which the image forming apparatus operates in a monochrome printing mode, and FIG. 7C illustrating a hibernated state. The image forming apparatus 10A according to the present exemplary embodiment may include components that are the same as those of the image forming apparatus 10 according to the first exemplary embodiment discussed above, except that the profile of the intermediate transfer belt 31 is changeable. Thus, constituent elements of the image forming apparatus 10A according to the present exemplary embodiment that are the same as the constituent elements of the image forming apparatus 10 according to the first exemplary embodiment are denoted by like reference numerals to omit description thereof, and only constituent elements of the image forming apparatus 10A that are different from those of the image forming apparatus 10 according to the first exemplary embodiment will be described. In FIGS. 7A to 7C, a portion corresponding to an image forming section 12A of the image forming apparatus 10A is illustrated and, further, components of the toner image forming sections 20 other than the photosensitive drums 22 are not illustrated. While the profile of the intermediate transfer belt 31 is changed when the printing mode is changed and when a transition is made to a hibernated state in the image forming apparatus 10A according to the present exemplary embodiment described below, the present disclosure is not limited thereto. That is, the present disclosure is similarly applicable to image forming apparatuses in which the profile of the intermediate transfer belt 31 is changed at timings that are different from the timings discussed above.

In a transfer device 30A of the image forming apparatus 10A according to the present exemplary embodiment, as illustrated with reference to FIG. 1 and FIG. 7A, at least one of the support rollers 33 may be configured to move the intermediate transfer belt 31 supported by the support roller 33 in directions closer to and away from the photosensitive drum 22 (particularly 22(Y), 22(M), 22(C), and 22(K)) of an adjacent toner image forming section 20 (particularly 20(Y), 20(M), 20(C), and 20(K)). Specifically, in the present exemplary embodiment, the support rollers 33 that move the intermediate transfer belt 31 include four first transfer rollers 331A that face the four photosensitive drums 22(Y), 22(M), 22(C), and 22(K), respectively, and a plurality of (three in FIGS. 7A to 7C) driven rollers 333A positioned downstream of the photosensitive drum 22(Y) for yellow and upstream of the photosensitive drum 22(K) for black in the transport direction of the intermediate transfer belt 31, among the plurality of support rollers 33. The first transfer rollers 331A and the driven rollers 333A discussed above may be driven by known actuators etc. Hence, such actuators etc. are not described in detail.

In the image forming apparatus 10A according to the present exemplary embodiment, different states of the profile of the intermediate transfer belt 31 include three states, namely a state in which the image forming apparatus 10A is operating in the full-color printing mode (see FIG. 7A), a state in which the image forming apparatus 10A is operating in the monochrome printing mode (see FIG. 7B), and a state in which the image forming apparatus 10A is in the hibernated state (see FIG. 7C) such as when the image forming apparatus 10A has been turned off or is in a power-saving mode. While switching may be made among the three states in units of jobs, switching is sequentially made among the three states in the following description.

In the case where the image forming apparatus 10A is operating in the full-color printing mode, as illustrated in FIG. 7A, all the four first transfer rollers 331A and the three driven rollers 333A discussed above are preferably positioned at positions at which the rollers have been moved in the direction closer to the corresponding photosensitive drums 22. Consequently, the intermediate transfer belt 31 sequentially contacts the photosensitive drums 22(Y), 22(M), 22(C), and 22(K) for the respective colors so that toner images in the respective colors are sequentially transferred (first transfer) to the intermediate transfer belt 31. Consequently, a full-color image is transferred to the recording medium P in the transfer region TA.

In the case where the image forming apparatus 10A transitions from the full-color printing mode illustrated in FIG. 7A to the monochrome printing mode illustrated in FIG. 7B, at least one of the support rollers 33 (see FIG. 1) is moved. Particularly, three first transfer rollers 331A that face the photosensitive drums 22 excluding the photosensitive drum 22(K) for black and the three driven rollers 333A are moved in directions M1 away from the photosensitive drums 22. When such movement is completed, as illustrated in FIG. 7B, only the photosensitive drum 22(K) for black is in contact with the intermediate transfer belt 31 with the photosensitive drums 22(Y), 22(M), and 22(C) for yellow, magenta, and cyan not contacting the intermediate transfer belt 31. Consequently, a monochrome image is transferred to the recording medium P in the transfer region TA.

When the mode change discussed above is executed, the circumferential length of the intermediate transfer belt 31 becomes shorter than that at the time when the image forming apparatus 10A is operating in the full-color printing mode by an amount corresponding to the movement of the support rollers (first transfer rollers 331A and driven rollers 333A) discussed above. Thus, in the image forming apparatus 10A according to the present exemplary embodiment, the second tension roller 61 is moved in a direction m1 of pressing the intermediate transfer belt 31 by driving the stepping motor 643 in correspondence with the movement of the support rollers 33 (see FIG. 1) for moving the intermediate transfer belt 31 discussed above.

Also in the case where the image forming apparatus 10A transitions from the monochrome printing mode illustrated in FIG. 7B to the hibernated state illustrated in FIG. 7C, at least one of the support rollers 33 (see FIG. 1) is moved. Particularly, one first transfer roller 331A that faces the photosensitive drum 22(K) for black is moved in a direction M1 away from the photosensitive drum 22. When such movement is completed, as illustrated in FIG. 7C, none of the four photosensitive drums 22(Y), 22(M), 22(C), and 22(K) is in contact with the intermediate transfer belt 31. At this time, the circumferential length of the intermediate transfer belt 31 is shorter than that at the time when the image forming apparatus 10A is operating in the monochrome printing mode by an amount corresponding to the movement of the at least one support roller 33 discussed above. Thus, in the image forming apparatus 10A according to the present exemplary embodiment, the second tension roller 61 is preferably further moved in a direction m2 of pressing the intermediate transfer belt 31 by rotating the stepping motor 643 in correspondence with the movement of the support roller 33 for moving the intermediate transfer belt 31 discussed above. The second tension roller 61 may not be further moved in the case where the image forming apparatus 10A transitions to the hibernated state. Switching is made among the states (modes) discussed above. Thus, switching may be made from the full-color printing mode to the hibernated state, or from the hibernated state to the full-color printing mode or the monochrome printing mode, besides the transitions discussed above. A person skilled in the art would easily understand operation of the support rollers 33, operation of the second tensioner 60, etc. for such cases in consideration of the examples discussed above.

The appropriate distance of movement of the second tension roller 61 that accompanies variations in the profile of the intermediate transfer belt 31 discussed above is preferably specified using a control table etc. prepared in advance. In the control table, the distance of movement of the second tension roller 61 may be set for each mode of the image forming apparatus 10A. Additionally, a table for correcting the distance of movement of the second tension roller 61 corresponding to the surrounding environment of the image forming apparatus 10A (such as the internal temperature and the humidity of the image forming apparatus 10A), the estimated life of each constituent element, etc. may be further used. In addition, movement of the second tension roller 61 may be started at the timing when the mode is determined, along with movement of the support rollers 33 to move the intermediate transfer belt 31, or after such movement.

In the image forming apparatus 10A according to the present exemplary embodiment, optionally, driven rollers 333B, 333B are preferably disposed as the different roller between the first and second tension rollers 51, 61 and the toner image forming sections 20(K), 20(Y) which are adjacent to the first and second tension rollers 51, 61, respectively. When the driven rollers 333B are disposed between the first and second tension rollers 51, 61 and the toner image forming sections 20(K), 20(Y) in this manner, displacement of the transfer positions of the toner image forming sections 20(K), (20Y) due to displacement of the intermediate transfer belt 31 due to movement of the first and second tension rollers 51, 61 is suppressed.

Other Exemplary Embodiments

In the second exemplary embodiment, the state of the first tensioner 50 is not taken into consideration, and therefore the value of the tension applied to the intermediate transfer belt 31 may deviate from an expected value because of fluctuations etc. in the position at which the first tension roller 51 is stopped, for example. In order to suppress such fluctuations, the method of controlling the profile of the intermediate transfer belt 31 on the basis of the operation mode of the image forming apparatus 10A according to the second exemplary embodiment and the method of controlling the profile of the intermediate transfer belt 31 using the position detection section 56 of the image forming apparatus 10 according to the first exemplary embodiment may be combined with each other.

Specific examples of a method obtained by combining the two methods of controlling the profile of the intermediate transfer belt 31 discussed above include the following method. That is, when the image forming apparatus is turned on, for example, the profile of the intermediate transfer belt 31 is controlled on the basis of the detection results from the position detection section 56 to specify the initial positions of the first and second tensioners 50, 60. When the initial positions are specified, the operation mode of the image forming apparatus is detected, and the distance of movement of the second tension roller 61 corresponding to the detected operation mode is specified using a control table. Operation such as image formation is executed after the second tension roller 61 is moved by the specified distance of movement. The operation mode that is used may be detected by analyzing an instruction for operation acquired by the image forming apparatus, or by detecting the positions of the support rollers 33.

While the image forming apparatus according to each exemplary embodiment discussed above includes the transfer device 30, 30A including the intermediate transfer belt 31, the present disclosure is not limited thereto. Specifically, the image forming apparatus may be a direct transfer type in which toner images formed on one or more photosensitive drums are directly transferred to a recording medium transported on a transport belt, for example. In this case, the transport belt that transports the recording medium may be wound around the first and second tension rollers etc. discussed above.

The present disclosure is not limited to the exemplary embodiments discussed above, and may be implemented with a variety of modifications without departing from the scope and spirit of the present disclosure. All such modifications are included in the technical idea of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:
an annular endless belt;
a drive roller, around which the endless belt is wound and which moves the endless belt;
a first tension roller, around which the endless belt moved by the drive roller is wound;
a biasing mechanism connected to the first tension roller and including an elastic member that applies a tension to the endless belt via the first tension roller;
a second tension roller, around which the endless belt moved by the drive roller is wound at a different position from the first tension roller; and
a moving mechanism connected to the second tension roller to move the second tension roller in directions closer to and away from the endless belt, a range of adjustment of a circumferential length of the endless belt by the moving mechanism being larger than a range of adjustment of the circumferential length of the endless belt by the biasing mechanism.

2. The image forming apparatus according to claim 1, further comprising:
a position detection section that detects a position of the first tension roller,
wherein the moving mechanism moves the second tension roller on a basis of a result output from the position detection section.

3. The image forming apparatus according to claim 2, further comprising:
a plurality of support rollers, around which the endless belt is wound,
wherein the moving mechanism moves the second tension roller on a basis of variations in profile of the endless belt due to movement of at least one of the support rollers.

4. The image forming apparatus according to claim 3, wherein the first tension roller is provided on an inner peripheral side of the endless belt, and the second tension roller is provided on an outer peripheral side of the endless belt.

5. The image forming apparatus according to claim 4, wherein the second tension roller is disposed at a position adjacent to the drive roller.

6. The image forming apparatus according to claim 3, wherein the moving mechanism moves the second tension roller on a basis of an operation state of the image forming apparatus.

7. The image forming apparatus according to claim 2, wherein the first tension roller is provided on an inner peripheral side of the endless belt, and the second tension roller is provided on an outer peripheral side of the endless belt.

8. The image forming apparatus according to claim 7, wherein the second tension roller is disposed at a position adjacent to the drive roller.

9. The image forming apparatus according to claim 7, wherein the moving mechanism moves the second tension roller on a basis of an operation state of the image forming apparatus.

10. The image forming apparatus according to claim 2, wherein the moving mechanism moves the second tension roller on a basis of an operation state of the image forming apparatus.

11. The image forming apparatus according to claim 1, further comprising:
a plurality of support rollers, around which the endless belt is wound,
wherein the moving mechanism moves the second tension roller on a basis of variations in profile of the endless belt due to movement of at least one of the support rollers.

12. The image forming apparatus according to claim 11, wherein the first tension roller is provided on an inner peripheral side of the endless belt, and the second tension roller is provided on an outer peripheral side of the endless belt.

13. The image forming apparatus according to claim 12, wherein the second tension roller is disposed at a position adjacent to the drive roller.

14. The image forming apparatus according to claim 3, wherein the moving mechanism moves the second tension roller on a basis of an operation state of the image forming apparatus.

15. The image forming apparatus according to claim 1, wherein the first tension roller is provided on an inner peripheral side of the endless belt, and the second tension roller is provided on an outer peripheral side of the endless belt.

16. The image forming apparatus according to claim 15, wherein the second tension roller is disposed at a position adjacent to the drive roller.

17. The image forming apparatus according to claim 15, wherein the moving mechanism moves the second tension roller on the basis of an operation state of the image forming apparatus.

18. The image forming apparatus according to claim 1, wherein the moving mechanism moves the second tension roller on a basis of an operation state of the image forming apparatus.

19. The image forming apparatus according to claim 1, further comprising:

a plurality of first transfer rollers that transfer an image to an outer peripheral surface of the endless belt, wherein a different roller, around which the endless belt is wound, is disposed between the first tension roller and the plurality of first transfer rollers and between the second tension roller and the plurality of first transfer rollers in a direction of movement of the endless belt.

20. The image forming apparatus according to claim 1, further comprising:

a transfer roller that forms a transfer region between the endless belt and the transfer roller to transfer an image onto a recording medium when the recording medium passes through the transfer region, wherein the first tension roller is disposed at a position adjacent to the transfer roller.

* * * * *